United States Patent [19]

Dennis et al.

[11] 4,329,900

[45] May 18, 1982

[54] BACON SLICING MACHINE

[75] Inventors: Edmund G. Dennis, Belle Tenne; C. Edward Brandmaier, Centerport, both of N.Y.

[73] Assignee: Cashin Systems Corporation, Hauppauge, N.Y.

[21] Appl. No.: 111,325

[22] Filed: Jan. 11, 1980

[51] Int. Cl.[3] ..... B26D 7/06

[52] U.S. Cl. ..... 83/355; 83/76; 83/77; 83/418; 83/420; 83/422

[58] Field of Search ..... 83/76, 77, 355, 418, 83/420, 355, 422

[56] References Cited

U.S. PATENT DOCUMENTS

| | | | |
|---|---|---|---|
| 2,060,540 | 11/1936 | Straeten | 83/355 |
| 3,354,920 | 11/1967 | Hertwig | 83/418 |
| 3,605,837 | 9/1971 | Lambert et al. | 83/77 X |
| 3,880,035 | 4/1975 | Divan | 83/420 |
| 3,905,259 | 9/1975 | Spooner | 83/77 |
| 4,015,494 | 4/1977 | Spooner et al. | 83/76 |
| 4,151,722 | 5/1979 | Johnson | 83/355 |

*Primary Examiner*—Donald R. Schran

*Attorney, Agent, or Firm*—Kane, Dalsimer, Kane, Sullivan and Kurucz

[57] ABSTRACT

A bacon slicing machine having a rotating slicing blade and a feed bed adjacent said blade across which it moves forwardly into the path of the blade by a conveyor arrangement; a hold down device laterally disposed above said bed and send product when thereon comprising rotatable grippers biased toward said bed into engagement with the upper surface of the product during operation to provide for a controlled feed of the product adjacent the blade, compensating for the pull of the blade, with the rotation of the gripper sychronized with the feed of the product via the conveyor arrangement.

14 Claims, 5 Drawing Figures

BACON SLICING MACHINE

BACKGROUND OF THE INVENTION

The present invention relates to improvements in bacon belly slicing machines and in particular, improvements in controlling the feed of bacon bellies into a rotating slicing blade. There exists today a variety of types of slicing machines which are utilized in bacon slicing operations. In this regard, the slicing machine may be of a continuous feed type, as for example, that disclosed in U.S. Pat. No. 3,880,035 granted Apr. 29, 1975. Another type slicing machine may be that which utilizes a retractable feeding mechanism which is retracted when a belly has been consumed and completely sliced, so that the next belly may be put in place, as disclosed in U.S. Pat. No. 2,642,910 granted June 23, 1953 or U.S. Pat. No. 3,144,893 granted Aug. 18, 1964.

In the case of either type machine, or any other type bacon slicing machine, as the trailing end of the belly approaches the blade, the pull of the knife influences the feed of the product. Usually, unless there is substantial weigh of bacon reacting against this or perhaps effective gripping of the tail by the feed means, the end piece will be pulled into the blade, leading to splattering and incorrect slice thickness and package weight. To compensate for this, a variety of feed means and hold down devices adjacent the blade have been utilized.

In the case of the feed means gripping the rear portion of the belly, an obvious disadvantage is that the portion gripped is not sliced but withdrawn. More importantly, in the case of continuous slicing operation, the feed is usually provided by an endless chain conveyor, with a plurality of bellies in an end to end relationship being fed into the blade. By such an arrangement, the trailing end of the belly is drawn uncontrollably into the blade. To compensate for this, pressure fingers and feet have been provided along with an overhead tractor mechanism as disclosed in U.S. Pat. No. 3,354,920. The upper conveyor in conjunction with a lower conveyor feeds the bellies to a predetermined point with the fingers and feet engaging the belly adjacent the blade, providing a drag opposite to that of the pull of the blade. However, once the belly leaves the upper conveyor drive, it is relatively loose and the hold down fingers and feet, while providing drag and some stabilization, are still apt to vibrate and do not provide the most accurate control of the feed of the product. In slicing, approximately 8–10″ of belly slicing is not predictable, with random irregular slices and splattering resulting in incorrect or poor integrity of the sliced package portions and increased reject occurances.

An improvement on the foregoing is that disclosed in U.S. Pat. No. 3,880,035 aforementioned. There a spiked lower conveyor is utilized to a point short of the blade. Rather than an upper track, spring loaded shoes urge the bellies downward with a forward shoe and fingers provided to increase control over the feed adjacent the blade. A side finger is usually provided in both these arrangements to bias the belly laterally against a side rail to further aid in controlling the feed.

While these devices have been found satisfactory in many applications, it has become desirable to provide an improved feed means which is effective to a point closely adjacent to the blade and which will control, in an accurate manner, the feed of the belly beyond the conveyor or shoe arrangement.

In addition, since in either case slice thickness control, as for example, that disclosed in U.S. Pat. No. 3,910,141 and citations therein, is intended to regulate slice thickness by control of the speed of the conveyor drive, this control may be somewhat hampered by an arrangement which provides for indescriminate drag throughout slicing.

SUMMARY OF THE INVENTION

Accordingly, it is a principal object of the invention to provide a hold down device adjacent to the blade which will provide a controlled feed of the belly toward the blade, especially the trailing end of the belly.

It is another object to provide for a hold down device which may be utilized on a variety of slicing machines especially those of the continuous operation type and one which will allow a more effective incorporation of standard slice thickness control features, particularly with respect to the trailing end of the belly.

A yet further object is to provide for a hold down device which is utilizable in controlling the feed of bellies having varying dimensions.

In general accordance with the present invention, there is provided a two conveyor feed arrangement, upper and a lower, driving the bellies towards the blade in an end to end arrangement. The drive for those conveyors is usually connected to a weighing apparatus which supplies signals to said drive, to increase or decrease the rate of speed and accordingly the slice thickness, as necessary.

A hold down device is provided, adjacent the blade, beyond the upper conveyor to control the feed of the bellies up to approximately ½″–1″ of the blade. The device includes a plurality of grippers adapted to engage the upper surface of the belly adjacent the blade as it is being fed therein. The grippers are located on a shaft positioned on the forward end of a rack, which pivots about a rear shaft by a piston arrangement so to allow the biasing of the grippers downward during operation. This allows the device to accommodate varying belly sizes and raised for cleaning purposes.

The grippers shaft is connected to the main drive means which regulates the feed of the product. The gripper engages the belly's upper surface approximately ½–1″ from the blade during operation, with the grippers rotation regulating the feed of the belly. This rotation in turn is regulated by the main drive, thereby preventing the pull of the knife from influencing all but perhaps the final ½″ of the belly. In addition, since the main drive may be regulated by slice thickness control apparatus, and the grippers are driven by said drive, slice thickness control is efffectively maintained throughout substantially all slicing of the belly.

The aforementioned advantages in addition to those which will become apparent from the following detailed description taken in conjunction with the accompanying drawings will be realized by the present invention.

DESCRIPTION OF THE PREFERRED EMBODIMENT

Figure 1:
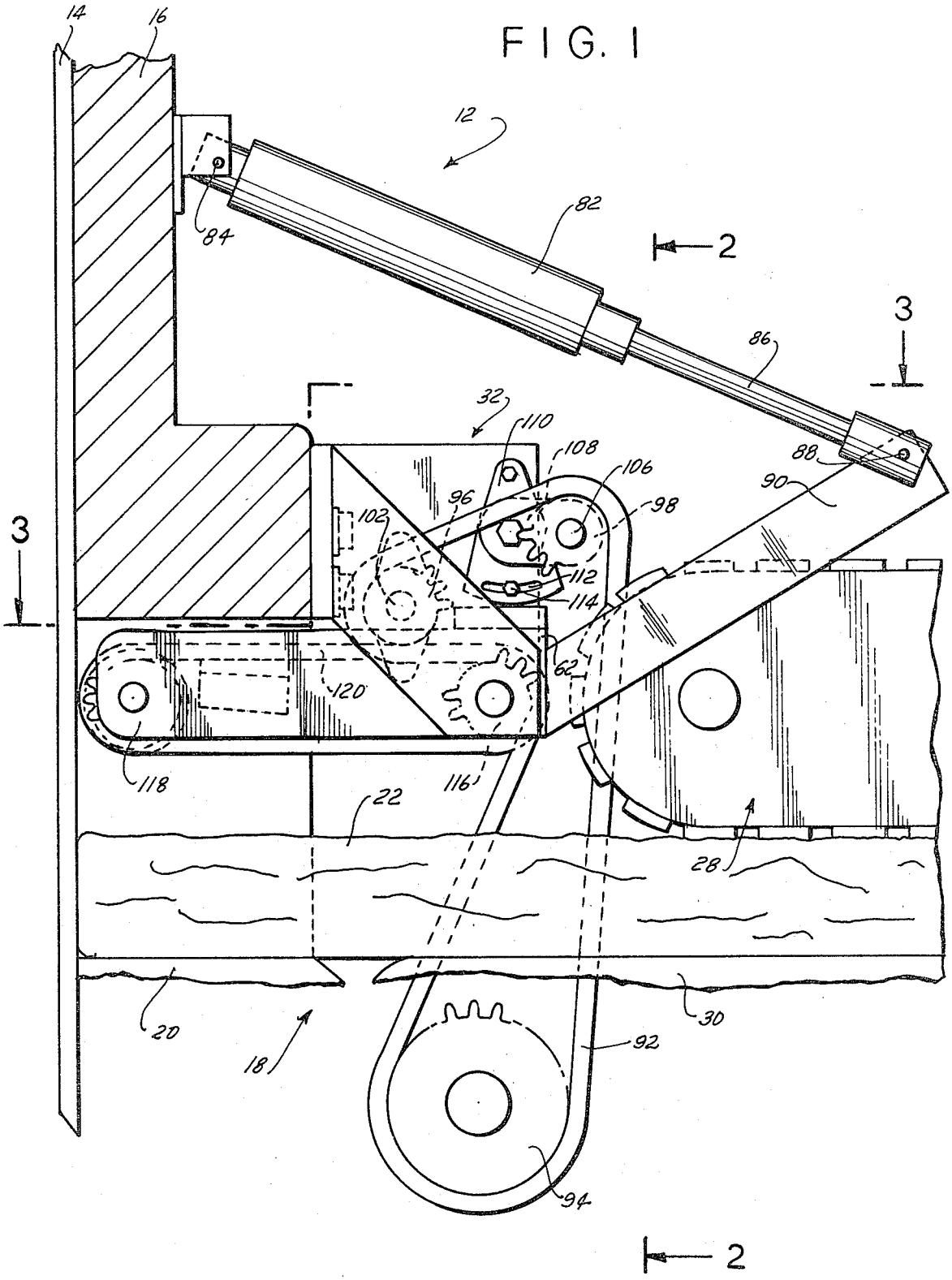
FIG. 1 is a partly sectional, side view of a two conveyor feed, continuous slicing machine utilizing the hold down device incorporating the teachings of the present invention, with said device in its raised position.
Figure 2:
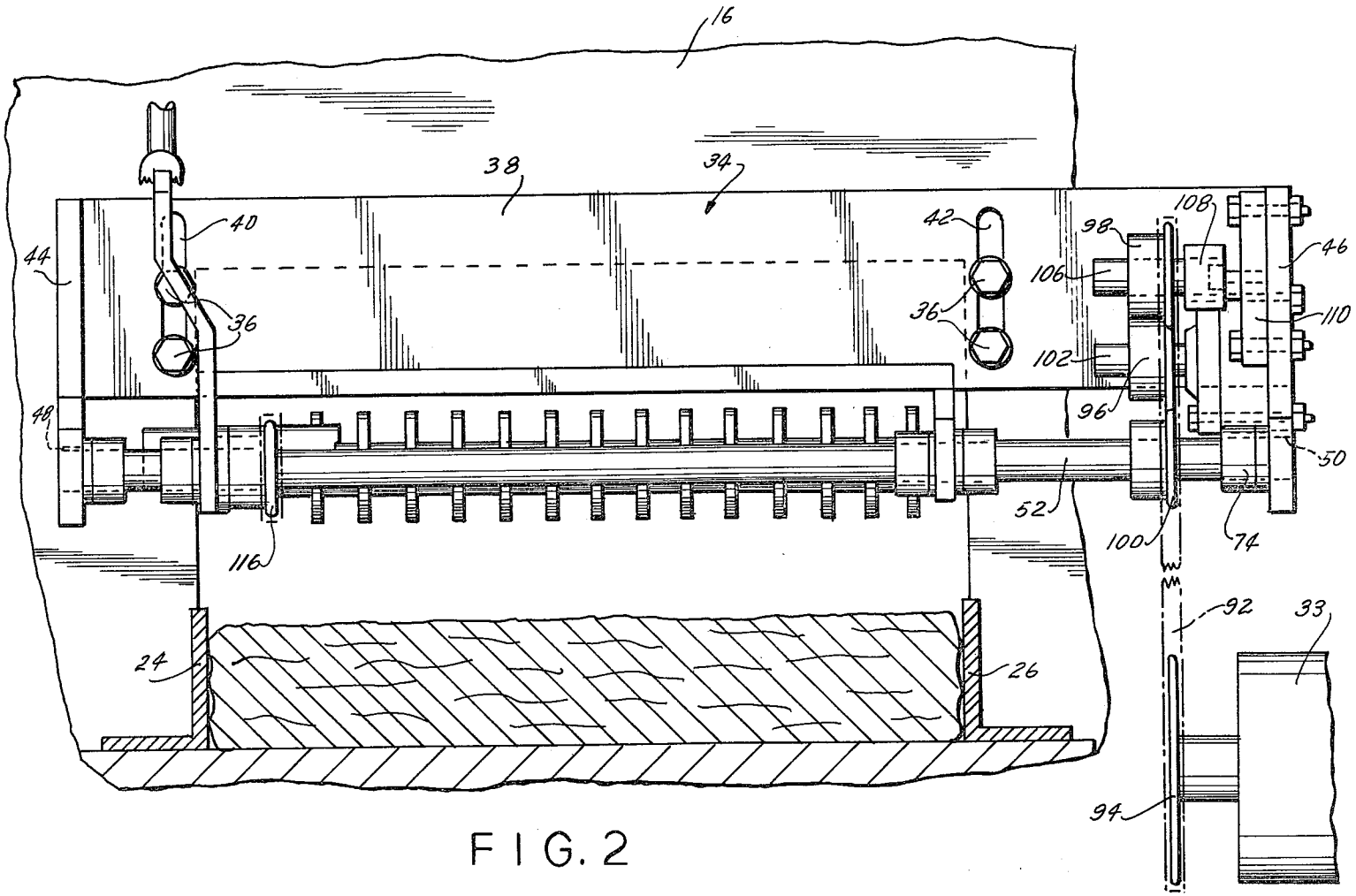
FIG. 2 is a vertical and somewhat sectional view of the hold down device taken along line 2—2 of FIG. 1.

The illustrated slicing machine 12 to which the present system is particularly applicable is one of a number usable in this invention. Thus, slicing machine 12 may assume the form disclosed in the aforementioned patents or may be the slicing machine available commercially under the Hydro-Matic slicer which is fully disclosed in the operating instructions and the ANCO No. 827 or 827C Hydro-Matic Bacon Slicer available from the manufacturer, the Allbright-Nell Company of Chicago, Ill. However, it is preferred that the slicing machine 12 be of the continuous feed type well known in the art as depicted generally in U.S. Pat. Nos. 3,354,920 or 3,880,035 aforementioned. For this reason, features of the slicing machine 12 extraneous to the present invention will not be described in detail and for a more complete explanation thereof, reference should be made to the foregoing references.

The slicing machine 12 is provided with a slicing blade 14 which rotates by a shaft and drive motor (both not shown). A housing 16 is provided about the blade and is located on a supporting table 18. A feed bed 20 is provided on said table over which the belly 22 is fed by to the slicing blade 14. This bed may be partially defined by guide rails 24 and 26, which may be an adjustable nature to accommodate different size bellies if necessary.

The belly 22 is continuously fed forward towards the blade 14 by an adjustable upper conveyor mechanism 28 and a lower conveyor mechanism 30 generally shown as tractor conveyors for simplicity of illustration and description and may be similar to that disclosed in the aforenoted U.S. Pat. No. 3,354,920.

The lower conveyor 30 runs substantially throughout the length of the table, short of the feed bed 20, providing a substantially flat conveyor or surface, feeding the bellies to said bed. The upper conveyor is located at the forward end of the machine adjacent the hold down device 32 and is shown to be generally of two tread construction. Of course, the conveyor shoe arrangement discussed in U.S. Pat. No. 3,880,035 or other types of drives perhaps even utilizing a ram or pusher arrangement, as discussed, in the aforenoted patents may also be utilized.

The drive for the conveyors 28 and 30 may be provided by a main drive motor 33 which is illustrated as providing the drive for the hold down device, as later discussed. It might be noted that the drive motor for feeding the belly towards the blade is usually connected to slice thickness control apparatus, wherein said drive is signalled to increase or decrease the rate of feed of the belly to the blade and consequently increase and decrease the slice thickness. Examples of such arrangements are found in U.S. Pat. Nos. 3,099,304, granted July 30, 1963, U.S. Pat. No. 3,200,864, granted Aug. 17, 1965, U.S. Pat. No. 3,204,676, granted Sept. 7, 1965, U.S. Pat. No. 3,846,957 and U.S. Pat. No. 3,846,958, granted Nov. 12, 1974, U.S. Pat. No. 3,910,141, granted Oct. 7, 1965 and U.S. Pat. No. 4,065,911, granted Jan. 3, 1978, with the desired features of each readily adaptable to be included in the present arrangement.

Also, devices for monitoring the change in belly dimension and similar devices, as for example that shown in U.S. Pat. No. 2,768,666, granted Oct. 30, 1956, U.S. Pat. No. 2,966,186, granted Dec. 27, 1960, and U.S. Pat. No. 3,144,893, granted Aug. 18, 1964, and incorporating it into slice thickness control, may also be readily incorporated in the present arrangement.

With particular regard to the hold down device 32, it is shown to include a support brace 34, which is mounted on the housing 16 by way of four bolts 36. The brace 34 consists of a rear plate 38 having two button holes 40 and 42 provided therein for mounting and so that the brace and consequently the hold down device 32 may be adjusted with respect to its vertical displacement from the feed bed 20 as desired during installation. The bolts 36 may be loosened and the brace, having the hold down device, adjusted so that it is generally positioned to engage the size belly being sliced. The pivoting arrangement of the hold down device, as later discussed, by its nature, adjusts to varying belly sizes during operation.

Two arms 44 and 46 extend perpendicular and downward from the plate 38 each provided with bearing surfaces 48 and 50 positioned in parallel respectively, which receive a drive shaft 52. Arm 44 is illustrated as being of a shape somewhat similar to a rectangle, pointed at each end, with arm 46 being somewhat square, having an increased area so as to allow mounting of gears thereon as later discussed.

As shown, the brace 34 is mounted above the feed bed, with its arms extended rearwardly and downwardly to allow the positioning of a rack 54 supporting a plurality of gripper elements 56 in the space between the feed bed 20 and the surface 58 of the housing 16, immediately adjacent the blade 14.

The rack 54 is provided with two rectangular members 60 and 62 in parallel arrangement, with cross members 64 and 66 connecting the two. The connection between these members may be welded, or press fitted in the case of member 64 or any other means to provide a durable connection. Provided in each member 60 and 62 are two bearing surfaces 68 and 70 which are axially disposed with respect to the corresponding bearing surface on the opposite member. These bearings allow the rack to support shaft 72, and allows the rack to be pivotally supported by shaft 52 with shaft 72 rotatably mounted in bearings 68; with shaft 52 passing through bearing surfaces 70 and rotatably mounted in bearing surfaces 48 and 50. A number of clamps 74 are provided on shaft 52 to prevent axial movement of the shaft and rack during operation. This arrangement allows for easy removal of the rack when necessary for cleaning etc., by disengaging the clamps.

The shaft 72 supports gripper elements 56 which may be each fixedly mounted on said shaft or, as illustrated, may be mounted on a sleeve 78 which in turn is fixedly mounted to shaft 72 by way of set screws 80. In any case, the arrangement provides that rotation of the shaft 72 results in a corresponding rotation of the grippers 56. Also, a keyed shaft may be utilized as shaft 72 to insure corresponding rotation of the grippers suitably mounted.

The role of the grippers 56 is to engage the upper surface of the belly as it is fed into the blade, effectively gripping it, with the rotation of the grippers determining the rate of feed of the product; with said gripper rotation regulated by the main drive motor 33, as later discussed. This effectively prevents the pull of the blade from influencing the feed of the product which otherwise would lead to inefficient operation. In addition, since the drive motor 33 is intended to be responsive to slice thickness control signals, and the grippers are regulated by said motor, slice thickness control may be effectively maintained throughout the entire slicing operation.

It should be understood that any form of gripping element may be utilized in this arrangement and it has been found that the sprocket type has been particularly useful.

Rearward of the grippers is the drive shaft 52 which serves to pivotally support the rack 54 with respect to the brace 34. Pivoting of the rack is provided by a cylinder 82, rotatably mounted via mount 84 to the housing 16, having its piston 86 rotatably mounted via pin 88 to an arm 90 which is affixed to member 60.

Figure 4:
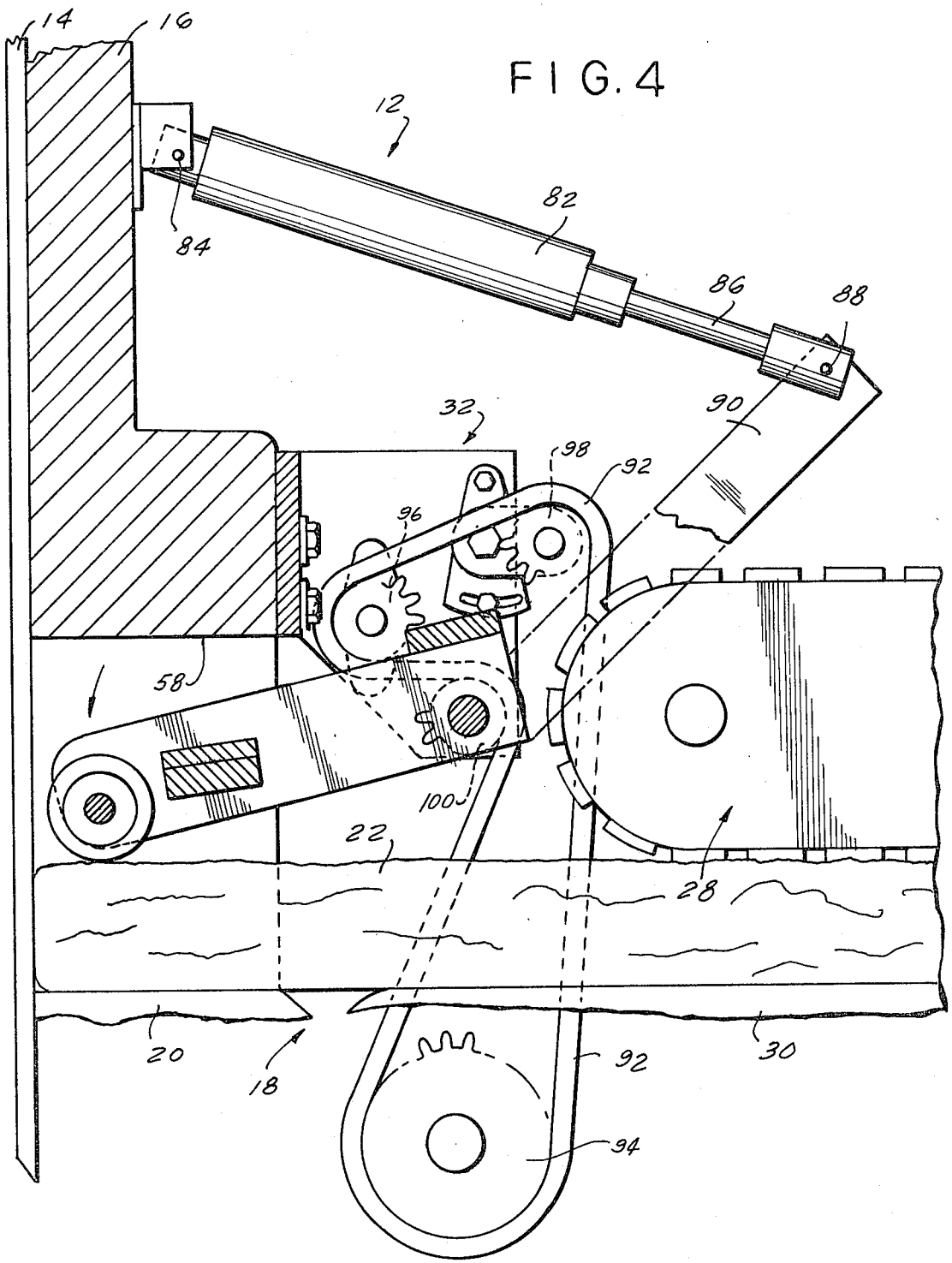
FIG. 4 is a partly sectional side view similar to FIG. 1 of the slicing machine utilizing the hold down device except with said device shown in a lowered position engaging the bacon belly.
Figure 5:
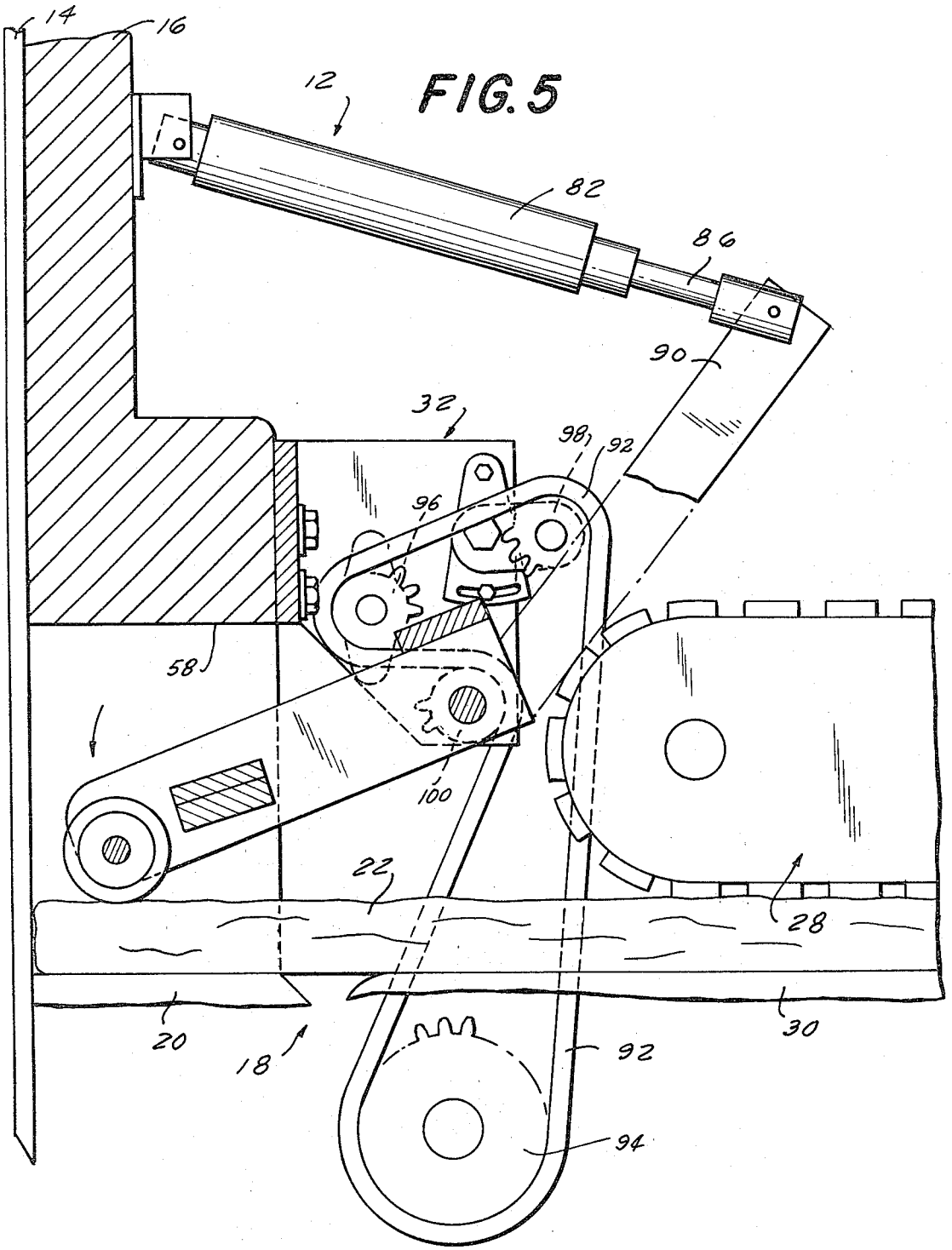
FIG. 5 is a view similar to that shown in FIG. 4 except the hold down device is shown in a lower position, engaging a loaf being of smaller thickness than that illustrated in FIG. 4.

The cylinder 82 may be of any type, pneumatic, hydraulic, electric etc., and can be activated in a conventionally appropriate manner. During operation of the machine, the cylinder would be activated to bias the rack towards the belly, which necessarily causes the grippers to engage the upper surface of the belly. This is shown clearly in FIGS. 4 and 5, with the cylinder 82 exerting a force to retract the piston into the cylinder thereby biasing the grippers into engagement with the belly. This force may be regulated as desired, and the degree of retraction varied according to belly size. In this regard, FIG. 4 shows a belly having a thickness of approximately 2" with the grippers engaging the same. As shown in FIG. 5, for a smaller thickness, the cylinder retracts the piston to a greater extent to provide biasing of the grippers into engagement with the belly. The opposite would be true for larger bellies where the cylinder retracts the piston to a lesser extent, and it is clear that the device may readily, in all cases provide control of the belly adjacent the blade, particularly the trailing end. In addition, as shown in FIG. 1, the piston 86 is fully extended with the rack in a raised position allowing for cleaning or to provide for free passage of the belly to the blade when desired.

As previously mentioned, the grippers 56 are driven by the same drive motor that drives the conveyor feed. Of course, if a separate drive motor was desired it could readily be incorporated, responsive to slice thickness control, and synchronized with the conveyor drive as necessary.

Drive for the hold down device utilizes an endless belt or drive chain 92 coupled with a gear 94 located on the motor 34. Gears 94, 96, 98, and 100 engage the chain 92, and allow for continuous drive to be conveyed to the grippers 56, regardless of the rack's position, without added adjustment.

Figure 3:
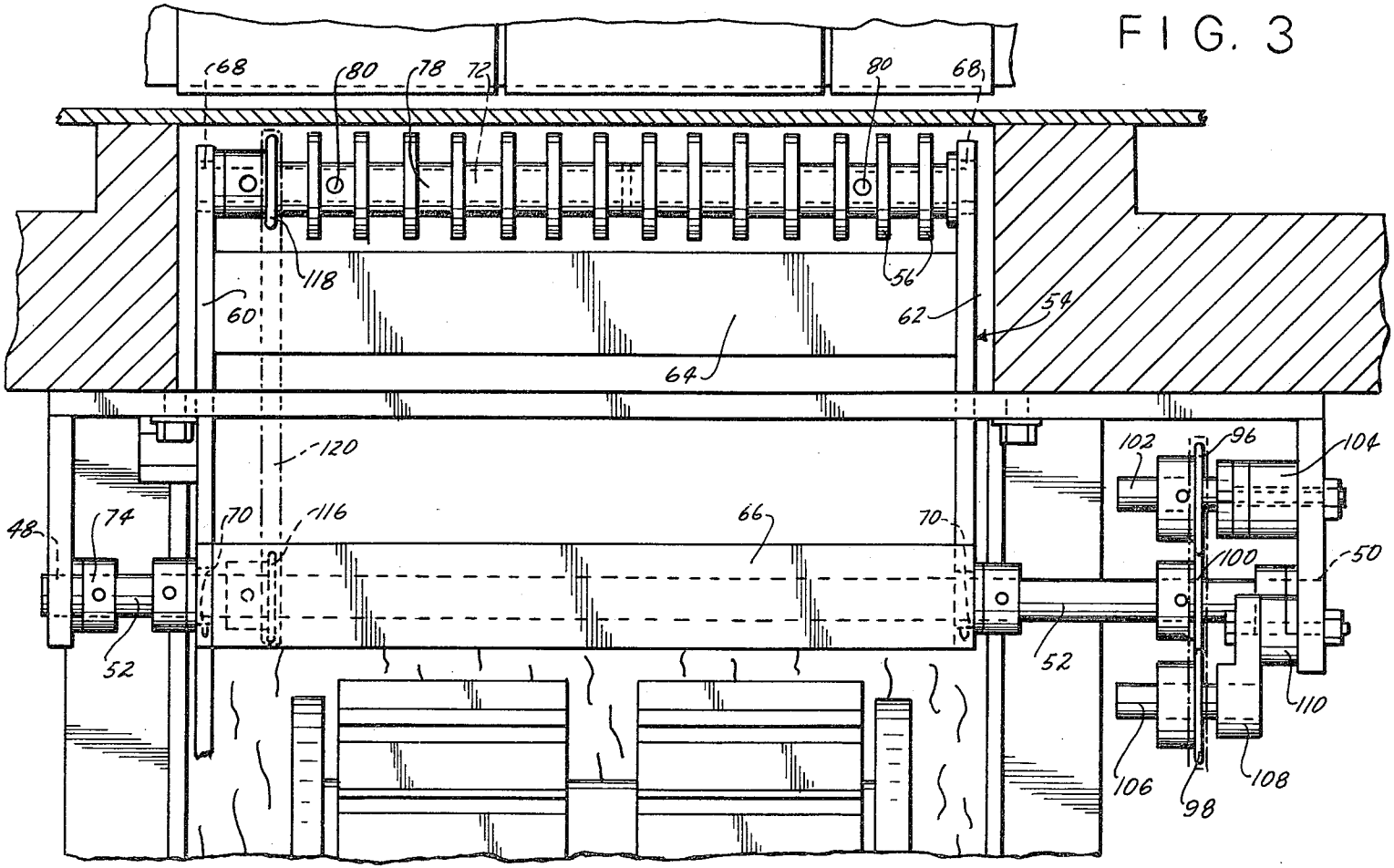
FIG. 3 is a plan and somewhat sectional view of the hold down device taken along line 3—3 of FIG. 1.

Gear 96 is an idler gear and is mounted on shaft 102 which in turn is rotatably mounted on plate 46 via bolts. A spacer 104 (shown clearly in FIG. 3) is provided to put the gear in the same plane as gears 94, 98, and 100. Gear 98 is mounted on shaft 106 which in turn is rotatably mounted in an extending arm 108 which in turn is mounted on a plate 110. The plate 110 is provided with a curved hutton hole 112, with a set bolt 114 mounted therethrough into plate 46, to allow the plate and according gear 98 to be adjusted to pick up any slack that exists in the drive chain 92 during installation.

The gear 100 is fixedly mounted on shaft 52. On the opposite side is provided gear 116, also fixedly mounted on shaft 52. To complete the drive chain, a gear 118 is fixedly mounted on shaft 72 and an endless belt or link chain 120 engaging gears 116 and 118.

By way of the foregoing, the drive from motor 33, causes a corresponding rotation of gear 100. This in turn causes shaft 52 to rotate, rotating gear 116, with belt 120 causing a corresponding rotation of gear 118, shaft 72 and grippers 56. As such, the grippers rotate at a fixed rate, governed by the motor 33 which can incorporate slice thickness control, while preventing the pull of the blade from influencing slicing no matter what position the rack is in.

While a preferred embodiment of the device has been disclosed and discussed in detail herein, it should be understood that its scope should not be limited thereby, rather its scope should be determined by that of the appended claims.

What is claimed is:

1. A slicing machine having: a slicing blade; a feed means for positively driving in a controlled manner product having a trailing end towards the blade at a predetermined rate while maintaining proper orientation of said product to insure uniform slice thickness as the trailing end of the product is sliced, said feed means includes a hold down means wherein said hold down means comprises at least one rotatable gripper engagable with the product at a point adjacent the blade, and control means controlling the rotation of said gripper and consequently the rate of advancement of the product towards the blade.

2. A slicing machine having: a rotating slicing blade; a feed means; a feed bed adjacent said blade across which a product is positively driven forwardly at a predetermined rate into the path of the blade by the feed means; said feed means includes a hold down means laterally disposed above said bed and adapted to engage the product when thereon so as to maintain proper orientation of the product as it is fed towards the blade to insure uniform slice thickness as the trailing end of the product is sliced; said hold down means comprising at least one rotatable gripper engageable with the product at a point adjacent the blade; and a control means for providing a control of the rotation of said gripper so as to provide a positive control of the rate of advancement of the product towards the blade.

3. A slicing machine in accordance with claim 2 wherein the hold down means is pivotally connected to said slicing machine and has an end adjacent the blade rotatably supporting said gripper and an opposite end supported by said machine; and a pivot means connected to said hold down means at its opposite end to provide a biasing force thereon to adjust the position of the gripper with respect to the feed bed.

4. The slicing machine in accordance with claim 3 wherein the pivot means is of the pneumatic, hydraulic or electric type having one end connected to said machine and another end connected to said hold down means.

5. The slicing machine in accordance with claims 1, 2, 3 or 4 wherein said control means comprises a drive motor.

6. The slicing machine in accordance with claim 5 which includes a drive means for conveying drive from said motor to said gripper to regulate the rotation of said gripper, wherein said drive means includes a first gear and link arrangement conveying drive to said hold down means; and a second gear and link arrangement conveying drive from the hold down means to the gripper.

7. The slicing machine in accordance with claims 5 wherein said feed means includes an endless conveyor having an run defining a substantially flat conveyor surface with said conveyor surface engaging the product for feeding it forwardly into the blade during operation.

8. The slicing machine in accordance with claim 7 wherein said feed means further includes an overhead feed conveyor spaced above said endless conveyor and said overhead conveyor being parallel with said endless conveyor and adapted to engage the upper surface of the product.

9. The slicing machine in accordance with claim 7 wherein said motor provides drive for said endless conveyor with the rotation of the gripper sychronized with the drive for said endless conveyor.

10. The slicing machine in accordance with claim 8 wherein said motor provides drive for said endless conveyor with the rotation of the gripper sychronized with the drive for said endless conveyor.

11. The slicing machine in accordance with claims 1 or 2 which further includes a plurality of grippers and each gripper is circular in shape.

12. The slicing machine in accordance with claim 5 wherein said motor is variable in speed, and variation of the speed of the motor results in variation of the rate of advancement of the product towards the blade and consequently variation of the slice thickness of the product.

13. A slicing machine in accordance with claim 1 wherein the hold down means is pivotally connected to said slicing machine and has an end adjacent the blade rotatably supporting said gripper and an opposite end supported by said machine; and a pivot means connected to said hold down means at its opposite end to provide a biasing force thereon to adjust the position of the gripper.

14. The slicing machine in accordance with claim 13 wherein the pivot means is of the pneumatic, hydraulic or electric type having one end connected to said machine and another end connected to said hold down means.

* * * * *